US008418378B2

(12) United States Patent
Nawrot et al.

(10) Patent No.: US 8,418,378 B2
(45) Date of Patent: Apr. 16, 2013

(54) CONDENSATION DRYER WITH A HEAT PUMP AND RECOGNITION OF AN IMPERMISSIBLE OPERATING STATE AND METHOD FOR THE OPERATION THEREOF

(75) Inventors: Thomas Nawrot, Berlin (DE); Ulrich Nehring, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 278 days.

(21) Appl. No.: 13/056,425

(22) PCT Filed: Jul. 31, 2009

(86) PCT No.: PCT/EP2009/059915

§ 371 (c)(1),
(2), (4) Date: Jan. 28, 2011

(87) PCT Pub. No.: WO2010/015570

PCT Pub. Date: Feb. 11, 2010

(65) Prior Publication Data

US 2011/0173838 A1 Jul. 21, 2011

(30) Foreign Application Priority Data

Aug. 6, 2008 (DE) ..... 10 2008 041 019

(51) Int. Cl.
*F26B 3/00* (2006.01)

(52) U.S. Cl.
USPC ..... 34/486; 34/595; 34/601; 165/287; 62/285; 60/651

(58) Field of Classification Search ..... 34/381, 34/468, 595, 601, 606, 610; 68/20, 28; 62/93, 62/285; 165/43, 287; 60/525, 651
See application file for complete search history.

(56) References Cited

U.S. PATENT DOCUMENTS

| | | | | |
|---|---|---|---|---|
| 2,713,995 | A * | 7/1955 | Arkoosh et al. | 165/258 |
| 3,734,810 | A * | 5/1973 | Davis | 165/240 |
| 4,621,438 | A | 11/1986 | Lanciaux | |
| 6,158,148 | A | 12/2000 | Krausch | |
| 6,321,460 | B1 * | 11/2001 | Jin | 34/77 |
| 6,904,703 | B2 * | 6/2005 | Naganawa et al. | 34/596 |

(Continued)

FOREIGN PATENT DOCUMENTS

| | | |
|---|---|---|
| DE | 4034274 A | 4/1992 |
| DE | 3879357 T2 | 6/1993 |
| DE | 4304226 A1 | 8/1994 |

(Continued)

*Primary Examiner* — Stephen M. Gravini
(74) *Attorney, Agent, or Firm* — James E. Howard; Andre Pallapies

(57) ABSTRACT

A condensation dryer is provided which has a heat pump in which a coolant circulates; a compressor; a temperature sensor to measure a temperature of the coolant; and a controller. The controller has a first comparator to compare the temperature of the coolant with an upper limiting temperature of the coolant; a switch to switch the compressor off if the temperature of the coolant is greater than or equal to the upper limiting temperature and to switch the compressor on after each compressor disconnection. A counter ascertains the number of occurrences at which the compressor is switched off. The counter is incremented by 1 each time the compressor is switched off. A second comparator compares the number of occurrences with a prespecified limiting number and evaluates the difference between the number of occurrences and the prespecified limiting number with respect to the presence of an impermissible operating state.

19 Claims, 5 Drawing Sheets

U.S. PATENT DOCUMENTS

| | | | | |
|---|---|---|---|---|
| 7,055,262 | B2 * | 6/2006 | Goldberg et al. | 34/86 |
| 8,266,813 | B2 * | 9/2012 | Grunert et al. | 34/85 |
| 8,266,824 | B2 * | 9/2012 | Steiner | 34/595 |
| 2005/0262720 | A1 * | 12/2005 | Rane et al. | 34/330 |
| 2007/0169367 | A1 | 7/2007 | Tadano | |
| 2009/0165328 | A1 * | 7/2009 | Grunert et al. | 34/443 |
| 2010/0011615 | A1 * | 1/2010 | Steiner | 34/493 |
| 2010/0146809 | A1 * | 6/2010 | Grunert et al. | 34/443 |
| 2011/0119952 | A1 * | 5/2011 | Nawrot et al. | 34/427 |
| 2011/0173838 | A1 * | 7/2011 | Nawrot et al. | 34/468 |
| 2011/0209357 | A1 * | 9/2011 | Ediger et al. | 34/595 |
| 2012/0096732 | A1 * | 4/2012 | TeGrotenhuis | 34/82 |

FOREIGN PATENT DOCUMENTS

| | | | |
|---|---|---|---|
| DE | 19638865 | A1 | 3/1997 |
| DE | 19858152 | A1 * | 6/2000 |
| DE | 4023000 | C2 | 2/2003 |
| EP | W02008086933 | A1 | 7/2008 |
| JP | W02005075728 | A1 | 8/2005 |
| JP | 2007-301130 | A | 11/2007 |
| WO | WO 8605575 | A1 * | 9/1986 |

* cited by examiner

CONDENSATION DRYER WITH A HEAT PUMP AND RECOGNITION OF AN IMPERMISSIBLE OPERATING STATE AND METHOD FOR THE OPERATION THEREOF

BACKGROUND OF THE INVENTION

The invention relates to a condensation dryer having a drying chamber for the items to be dried, a process-air circuit, a first fan in the process-air circuit, a heat pump in which a coolant circulates and that has an evaporator, a compressor, a condenser, and a throttle, and further having a temperature sensor for measuring a temperature of the coolant, and a controller, and also to a preferred method for operating the dryer.

A condensation dryer of said kind and a method for operating it proceed from DE 40 23 000 C2.

In a condensation dryer, air (what is termed process air) is ducted by a fan across a heater into a drum as a drying chamber containing damp laundry items. The hot air absorbs moisture from the laundry items requiring to be dried. Having passed through the drum, the then moist process air is ducted into a heat exchanger upstream of which as a rule a lint filter is connected. The moist process air is cooled in said heat exchanger (for example an air-air heat exchanger or a heat pump's heat sink) so that the water contained in the moist process air condenses. The condensed water is then generally collected in a suitable container and the cooled and dried air ducted back to the heater (which may be a heat pump's heat source) and then to the drum.

That drying process is in certain circumstances very energy-intensive because the cooling-air current heated in the heat exchanger as the process air is cooled can in energy terms be lost to the process. That energy loss can be significantly reduced by employing a heat pump. In the case of a condensation dryer fitted with a heat pump the warm, moisture-laden process air is cooled substantially in a heat sink of the heat pump, where the heat extracted from the process air is used for, for example, evaporating a coolant employed in the heat-pump circuit. The heat absorbed in the heat sink is transported inside the heat pump to the heat source and there given off again—possibly at a temperature raised above that at the heat sink. In a heat pump, which operates with a coolant as the heat-transporting means, with the coolant being evaporated in the heat sink and condensed in the heat source, via a compressor the evaporated, gaseous coolant reaches the heat source, which can here be designated a condenser, where, owing to the gaseous coolant's being condensed, heat is released that is used for heating the process air before it enters the drum. The condensed coolant finally flows back to the evaporator through a throttle; the throttle serves to reduce the internal pressure in the coolant so it can evaporate in the evaporator with heat again being absorbed. The heat pump that is operated in such a way with a circulating coolant is known also as a "compressor heat pump". Other heat pump designs are also known.

DE 40 23 000 C2 discloses a laundry dryer that has a heat pump and arranged in which in the process-air channel between the condenser and evaporator is an incoming-air orifice that can be sealed with a controllable sealing device.

WO 2008/086933 A1 describes a condensation dryer having a drying chamber, a process-air circuit having a heater for heating the process air and a fan, an air-air heat exchanger and a heat-pump circuit having an evaporator, a compressor, and a condenser. Located in the heat-pump circuit between the condenser and evaporator is an additional heat exchanger that is functionally coupled to the air-air heat exchanger. The temperature of the heat pump's coolant, particularly in the condenser, is kept within the permissible range via the heat pump's controller and the additional heat exchanger.

DE 40 34 274 A1 describes a laundry dryer and a method for monitoring the temperature therein, with the laundry dryer having a thermostat device connected to a heater for air and provided for registering the temperature of the air current, which device is set up for disconnecting the heater if an upper temperature value is exceeded and for connecting the heater again when the temperature falls below a lower value, and further having a monitoring circuit connected to the thermostat device for producing a signal, dependent on the disconnections, for an indicator unit. The monitoring circuit has a counter circuit for counting the heater disconnections having occurred during a drying process and is connected to the indicator unit. A decoding circuit can produce a fault signal when a specific number of disconnections has occurred. For example the laundry dryer's heater will be disconnected if the number of heater disconnections exceeds a reference value and a display unit will simultaneously be driven via which users are able to recognize or hear that they need to clean the lint filter and/or the condenser, or that the fan has suffered an outage.

DE 197 28 197 A1 discloses a method for detecting unacceptable operating conditions in a laundry dryer as well as a laundry dryer having the detection method of such kind. The aim of the method is to enable separate or joint recording of different operating conditions of too high temperature that originate in different regions. The temperature is recorded periodically in the supply-air current above a supply-air heater and in front of the laundry drum, a difference value or gradient is created from two successively recorded values, said difference value (gradient) is compared with a preset difference value (gradient), with—if the newly created difference value is greater in absolute terms than the preset difference value—a counting value being raised by a step, said value being compared with a preset value, and—if the current value is greater than the preset value—the laundry-dryer heater being switched off and/or an operating-condition display activated.

The traditionally employed air-air heat exchanger—operated in crossover or counterflow mode—and the electric heater are generally completely replaced with a heat pump. Compared with a dryer having an air-air heat exchanger and a resistance heater it is possible thereby to achieve a 20-50% reduction in the energy required for a drying process.

A compressor-heat pump as a rule operates optimally within specific temperature ranges in the evaporator and the condenser. What is problematic about using a compressor-heat pump in the condensation dryer is the usually high temperature in the condenser, which for process reasons can result in its no longer being possible to condense or fully condense the coolant; the compressor will then have to be switched off and/or a substantial impairment in the heat pump's effectiveness will have to be accepted. That problem is even worse when the compressor is supported by an additional heater in the process-air circuit to achieve faster heating of the process air and hence shorter drying times. Moreover, the circulating process air can be impeded by soiled air paths. That can likewise cause the temperature of the coolant to rise. Operating states of such kind can result in damage to the heat pump or other parts of the dryer and so are impermissible.

In a conventional dryer an impermissible operating state, for example a reduced circulation of the process air (reduction in air performance) is ascertained by registering a temperature in the process-air current above a heater for the process air and in front of the drying chamber at regular intervals and forming from in each two successively registered values a difference value corresponding to a time gradient. That information generally does not have to be available in that form in the case of a dryer fitted with a heat pump (a heat-pump dryer). For example in a heat-pump dryer the heat pump is frequently sited further from the drying chamber than is the heater in a conventional condensation dryer. In any event, detecting an impermissible operating state in a condensation dryer fitted with a heat pump can in that way be done only imprecisely.

BRIEF SUMMARY OF THE INVENTION

The object of the invention was hence to provide both a condensation dryer having a heat pump and a method for operating said dryer whereby an impermissible operating state can be detected in a simple manner.

Said object is achieved according to the present invention by means of a condensation dryer having the features as set out in the corresponding independent claim and by means of the method as set out in the corresponding independent claim. Preferred embodiment variants of the inventive condensation dryer and of the inventive method are listed in corresponding dependent claims. Preferred embodiment variants of the inventive method correspond to preferred embodiment variants of the inventive condensation dryer and vice versa, even if that is not explicitly mentioned herein.

The subject matter of the invention is hence a condensation dryer having a drying chamber for the items requiring to be dried, a process-air circuit, a first fan in the process-air circuit, a heat pump in which a coolant circulates and that has an evaporator, a compressor, a condenser, and a throttle, and further having a temperature sensor for measuring a temperature of the coolant, and a controller, with the controller including first means for comparing a temperature $T_K$ of the coolant with an upper limiting temperature $T_K^{lim1}$ stored in the controller for the coolant; second means for switching the compressor off if $T_K$ is greater than or equal to $T_K^{lim1}$ and for switching the compressor on after each disconnection; a counting device for ascertaining a number n of cases in which the compressor is switched off, which counting device is incremented by 1 each time switching-off takes place; and third means for comparing the number n with a prespecified limiting number $n_{lim}$ stored in the controller and for evaluating the difference $\Delta n=(n-n_{lim})$ with respect to the presence of an impermissible operating state.

The term "impermissible operating state" employed herein is to be given a broad interpretation. What is meant by it is any operating state that can result in an adverse effect on a drying process and/or damage to the condensation dryer.

In a preferred embodiment of the inventive condensation dryer the second means are set up not to switch the compressor on until a delay period $\Delta t_v$ has expired in each case after a disconnection. What is particularly preferred is for the delay period $\Delta t_v$ to be greater than a period of time within which pressure equalizing occurs inside the heat pump in each case after a compressor disconnection. Pressure equalizing of such kind requires a time of approximately one minute; pressure differences developing in the coolant owing to the effects of the compressor and throttle between the condenser and evaporator are eliminated during that time, with the coolant in the condenser being expanded so that in particular its temperature drops. Disconnecting a compressor followed by pressure equalizing can therefore quickly and effectively terminate a critical operating state of the heat pump, which state is characterized by an excessively high temperature in the range of high pressure. The delay period $\Delta t_v$ is most particularly preferably about three minutes long.

In an additional preferred embodiment of the condensation dryer the second means are set up such that in each case on expiration of a delay period $\Delta t_v$ after the compressor has been disconnected it is initially ascertained whether $T_K$ is greater than or equal to $T_K^{lim1}$, that the compressor will not be switched on again unless $T_K$ is smaller than $T_K^{lim1}$, and that the counting device will be incremented by 1 and the compressor will not be switched on again until after a further delay period $\Delta t_v$ if $T_K$ is greater than or equal to $T_K^{lim1}$. Further measures will therein be possible, particularly extending the compressor's disconnection to gain extra time for eliminating an undesirably high temperature inside the heat pump, in the event that disconnecting the compressor does not result in quickly terminating the heat pump's critical operating state.

In another preferred implementation variant of the condensation dryer the temperature sensor is located on the outlet of the condenser or on the outlet of the compressor.

It is moreover preferred for an additional heat exchanger to be located in the inventive condensation dryer in the heat pump. In a preferred embodiment variant the additional heat exchanger is therein located in a process-air channel between the evaporator and condenser. The additional heat exchanger is alternatively located in a cooling-air channel, with its being possible for there to be an air-air heat exchanger in said cooling-air channel.

The inventive condensation dryer moreover preferably includes a second fan for cooling the heat pump. The second fan is located preferably in a cooling-air channel and/or in the vicinity of the compressor.

The inventive condensation dryer preferably has an acoustic and/or visual display means for displaying an impermissible operating state. A visual display means can be, for example, a liquid-crystal display on which specific requests or advisories are indicated. It is additionally or alternatively possible for light-emitting diodes to shine in one or more colors. The manner in which an impermissible operating state is displayed can be dependent on the type of impermissible operating state.

In the case of a generally less critical first impermissible operating state a request to clean the air paths in the condensation dryer could be indicated on, for example, a liquid-crystal display. Alternatively or additionally thereto a light-emitting diode could shine in the color, for example, orange.

In the case of a second impermissible operating state that is as a rule critical, an advisory that the drying process has been interrupted and the coolant circuit should be checked and/or a service engineer engaged could be indicated on, for example, a liquid-crystal display. Alternatively or additionally thereto a light-emitting diode could shine in the color, for example, red.

An acoustic indicator could also serve the purpose of a display, with its being possible for different impermissible operating states to be indicated by means of different bleep tones.

The process air can be heated exclusively via the heat pump's condenser. An electric heater can, though, also be used in addition.

If a further heater is used in the inventive condensation dryer alongside the heat pump, then it is preferably a two-stage heater. Said heater's controller is in a preferred embodiment variant of the invention likewise employed for regulating the temperature of the coolant.

The invention relates also to a method for operating a condensation dryer having a drying chamber for the items requiring to be dried, a process-air circuit, a first fan in the process-air circuit, a heat pump in which a coolant circulates and that has an evaporator, a compressor, a condenser, and a throttle, and further having a temperature sensor for measuring a temperature of the coolant, and a controller, with the controller including first means for comparing a temperature $T_K$ of the coolant with an upper limiting temperature $T_K^{lim1}$ stored in the controller for the coolant; second means for switching the compressor off if $T_K$ is greater than or equal to $T_K^{lim1}$ and for switching the compressor on after each disconnection; a counting device for ascertaining a number n of cases in which the compressor is switched off, which counting device is incremented by 1 each time switching-off takes place; and third means for comparing the number n with a prespecified limiting number $n_{lim}$ stored in the controller and for evaluating the difference $\Delta n=(n-n_{lim})$ with respect to the presence of an impermissible operating state, in the case of which method the following steps are performed:

(a) Setting the counting device to zero and switching-on of the compressor by the second means when the method begins;

(b) cyclically repeated measuring of a temperature $T_K$ of the coolant by means of the temperature sensor and comparing $T_K$ by means of the first means with an upper limiting temperature $T_K^{lim1}$ stored in the controller;

(c) switching-off of the compressor by the second means if $T_K$ is greater than or equal to (d) incrementing the number n in the counting device by the value 1 each time the compressor is switched off;

(e) switching-on again of the compressor by the second means in each case after a disconnection;

(f) comparing, by means of the third means, the number n with a prespecified limiting number $n_{lim}$ stored in the controller; and evaluating the difference $\Delta n=(n-n_{lim})$ with respect to the presence of an impermissible operating state.

Within the scope of a preferred development of this method the second means do not switch the compressor on again until after a delay period $\Delta t_v$ has expired in each case after a disconnection. Particularly preferably the second means (27) ascertain in each case on expiration of a delay period $\Delta t_v$ after the compressor (14) has been disconnected initially whether $T_K$ is greater than or equal to $T_K^{lim1}$, after which they will only switch the compressor (14) on again if $T_K$ is smaller than $T_K^{lim1}$ and after which the counting device will be incremented by 1 and the compressor will not be switched on again until after a further delay period $\Delta t_v$ if $T_K$ is greater than or equal to $T_K^{lim1}$. Pressure differences developing in the coolant owing to the effects of the compressor and throttle between the condenser and evaporator are eliminated during the delay period, with the coolant in the condenser being expanded so that in particular its temperature drops. Disconnecting a compressor followed by pressure equalizing can therefore quickly and effectively terminate a critical operating state of the heat pump, which state is characterized by an excessively high temperature in the range of high pressure. Further measures will where applicable be possible for terminating a critical operating state of the heat pump, particularly extending the compressor's disconnection to gain extra time for eliminating an undesirably high temperature inside the heat pump.

In another preferred development of the method a first impermissible operating state will be displayed if $\Delta n$ is greater than or equal to $n^1$, where $n^1$ is a prespecified value stored in the controller. The display of a first impermissible operating state can include the request to clean the air paths in the condensation dryer. It is further preferred for a second impermissible operating state to be displayed if $\Delta n$ is greater than or equal to $n^2$, where $n^2$ is a prespecified value stored in the controller. Apart from a second impermissible operating state being displayed it is therein possible for a drying process in progress to be interrupted.

It generally applies that $n^2>n^1$.

For regulating the temperature of the coolant in the heat pump a cooling device for the heat pump can be used that preferably includes a second fan. The second fan can be used directly for cooling components of the heat pump, particularly the compressor. The second fan and an additional heat exchanger are, though, preferably located in a cooling-air channel, with the additional heat exchanger being located in the heat pump. Yet a further air-air heat exchanger can be located in the cooling-air channel. The possibly present air-air heat exchanger is preferably detachable. That is particularly advantageous because a detachable heat exchanger can be more easily cleaned of lint.

It is inventively preferred for process air and cooling air or, as the case may be, process air and coolant in the heat pump to be ducted through the corresponding heat exchangers in each case by a crossover or counterflow method.

The coolant employed in the heat-pump circuit has preferably been selected from the group consisting of propane, carbon dioxide, and fluorinated hydrocarbon compounds. A coolant from the group that includes the known compounds or mixtures R134*a*, R152*a*, R407C, and R41OA is preferably used.

Alongside an evaporator, condenser, and compressor the heat pump in the inventive condensation dryer has a throttle—referred to also as an expansion valve or throttle valve—in the coolant's flow direction between the evaporator and condenser. The throttle can in particular be a valve, a capillary, or a restrictor.

The temperature of the heat pump's coolant, particularly in the condenser, is inventively generally kept within the permissible range via the heat pump's controller and possibly an additional heat exchanger. If the inventive condensation dryer has an additional heater in the process-air circuit in front of the entrance to the drying chamber, the heat pump's control will preferably be coordinated with that of the heater.

With less and less energy being needed for drying as the degree of dryness of the items requiring to be dried in the condensation dryer increases, it is expedient to regulate the heater accordingly, which is to say to reduce its heating power in line with the increasing degree of dryness in order to maintain a balance between the drying energy supplied and that which is necessary.

As the degree of dryness of the items requiring to be dried, particularly laundry, increases, a lower heating power or even an increasing cooling power of the heat pump will hence be required. In particular the temperature in the process-air circuit would rise sharply after a completed drying phase. The heat pump and, where applicable, an additional heater in the condensation dryer is hence in general regulated in such a way that a maximum permissible temperature will not be exceeded in the drying chamber.

BRIEF DESCRIPTION OF THE DRAWINGS

Further specifics of the invention will emerge from the following description of non-limiting exemplary embodiments of the inventive condensation dryer and a method employing said condensation dryer. Reference is therein made to FIGS. 1 to 5.

DETAILED DESCRIPTION OF EXEMPLARY EMBODIMENTS OF THE PRESENT INVENTION

Figure 1:
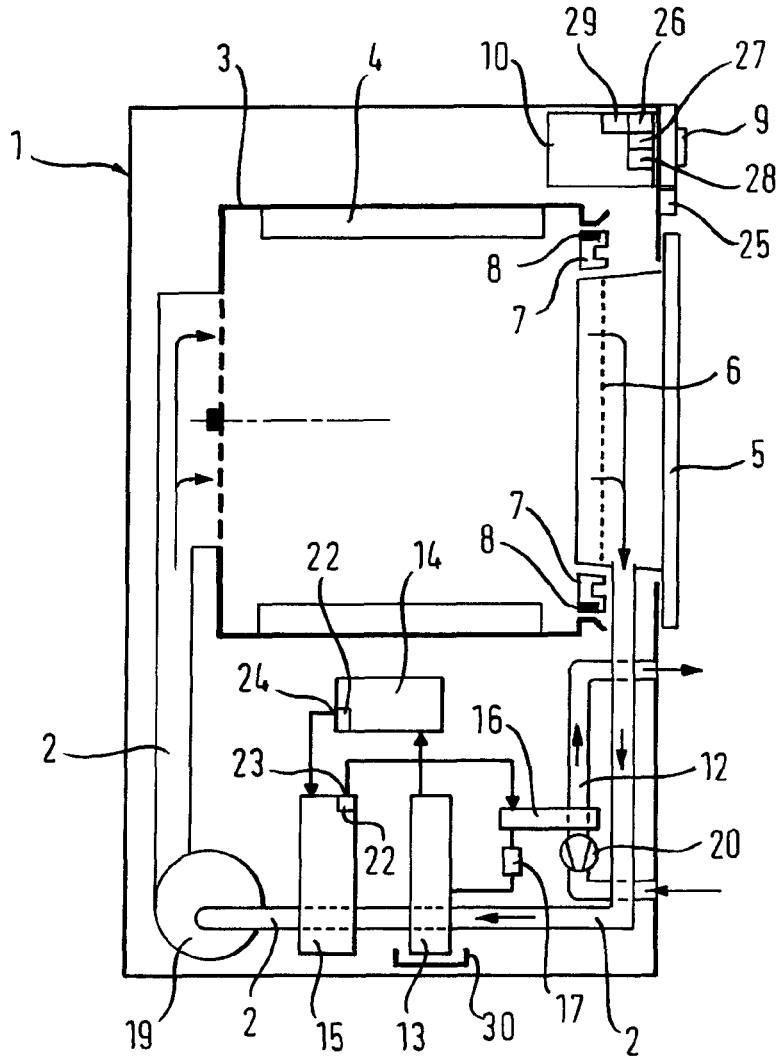
FIG. 1 shows a vertical section through a condensation dryer according to a first embodiment variant.

FIG. 1 shows a vertically sliced condensation dryer (abbreviated in the following to "dryer") according to a first embodiment variant in which the process air is heated exclusively via the heat pump's condenser.

The dryer 1 shown in FIG. 1 has a drum, rotatable around a horizontal axis, as a drying chamber 3 within which are secured carriers 4 for moving the laundry while the drum is rotating. Process air is ducted by means of a first fan 19 through a drum 3 and a heat pump 13, 14, 15, 17 in an air channel 2 in the closed circuit (process-air circuit 2). The process air heated in a condenser 15 of heat pump 13, 14, 15, 17 is cooled after passing through drum 3 and absorbing moisture and is heated again by condenser 15 after the moisture contained in the process air has been condensed. Heated air is therein ducted into drum 3 from behind, which is to say from a side of the drum 3 opposite a door 5 through said drum's perforated base, hence making contact there with the laundry requiring to be dried, and flows through the loading opening of the drum 3 to a lint filter 6 inside a door 5 sealing the loading opening. The air current is then diverted downward in the door 5 and ducted in the air channel 2 to the evaporator 13 of a heat pump 13, 14, 15, 17, where it is cooled. The condensate produced therein is captured in a condensate container 30 from where it can be disposed of by emptying or pumping away. The coolant of the heat pump 13, 14, 15, 17 evaporated in the evaporator 13 is ducted to the condenser 15 via a compressor 14. The coolant condenses in the condenser 15 and in so doing emits heat into the process air. The coolant now present in liquid form is then ducted to an additional heat exchanger 16, which together with a second fan 20 is located in a cooling-air channel 12, and from there via a throttle valve 17 back to the evaporator 13, as a result of which the coolant circuit will have been closed. The cooling air is taken from the ambient air and fed back to the ambient air after heat exchanging.

The drum 3 is mounted in the embodiment variant shown in FIG. 1 on the back base by means of a pivot bearing and at the front by means of an end shield 7, with the drum 3 being supported by a brim on a glide strip 8 on the end shield 7 and thus held at the front end. The condensation dryer is controlled via a controller 10 that can be regulated by the user via a control unit 9.

In addition to the controller 10 or integrated in the controller 10, the condensation dryer 1 includes a first means 26 for comparing a temperature $T_K$ of the coolant with an upper limiting temperature $T_K^{lim1}$ stored in the controller for the coolant; a second means 27 for switching the compressor 14 off if $T_K$ is greater than or equal to $T_K^{lim1}$; and switching the compressor 14 on again, and a counting device 28 for ascertaining a number n of cases in which the compressor 14 is switched off; and third means 29 for comparing the number n with a prespecified limiting number $n_{lim}$ stored in controller 10 and for evaluating the difference $\Delta n=(n-n_{lim})$ with respect to the presence of an impermissible operating state.

23 signifies the outlet of the condenser 15. 24 signifies the outlet of the compressor 14. In the embodiment variant shown in FIG. 1 a temperature sensor 22 is arranged at each of outlets 23 and 24.

A visual display means 25 serves to display an impermissible operating state, with its being possible for different colors to display different impermissible operating states.

A second means 27 is set up not to switch compressor 14 on until a delay period $\Delta t_v$ has expired in each case after a disconnection. Said delay period $\Delta t_v$ is in particular greater than a period of time within which pressure equalizing occurs inside the heat pump 13, 14, 15, 17 in each case after the compressor 14 has been disconnected. Pressure equalizing of such kind requires a time of approximately one minute; pressure differences developing in the coolant owing to the effects of the compressor 14 and the throttle 17 between the condenser 15 and the evaporator 13 are eliminated during that time, with the coolant in the condenser 15 being expanded so that in particular its temperature drops. Disconnecting the compressor 14 followed by pressure equalizing can therefore quickly and effectively terminate a critical operating state of the heat pump 13, 14, 15, 17, which state is characterized by an excessively high temperature in the range of high pressure. The delay period $\Delta t_v$ is specifically about three minutes long.

A second means 27 has furthermore been set up such that in each case on expiration of a delay period $\Delta t_v$ after the compressor 14 has been disconnected it is initially ascertained whether $T_K$ is greater than or equal to $T_K^{lim1}$, after which the compressor 14 will only be switched on again if $T_K$ is smaller than $T_K^{lim1}$ and after which the counting device 28 will be incremented by 1 and the compressor 14 will not be switched on again until after a further delay period $\Delta t_v$ if $T_K$ is greater than or equal to $T_K^{lim1}$. In the event that disconnecting the compressor 14 does not result in quickly terminating the critical operating state of the heat pump 13, 14, 15, 17, further measures will therein be possible, particularly extending disconnection of the compressor 14 to gain extra time for eliminating an undesirably high temperature inside the heat pump 13, 14, 15, 17.

Figure 2:
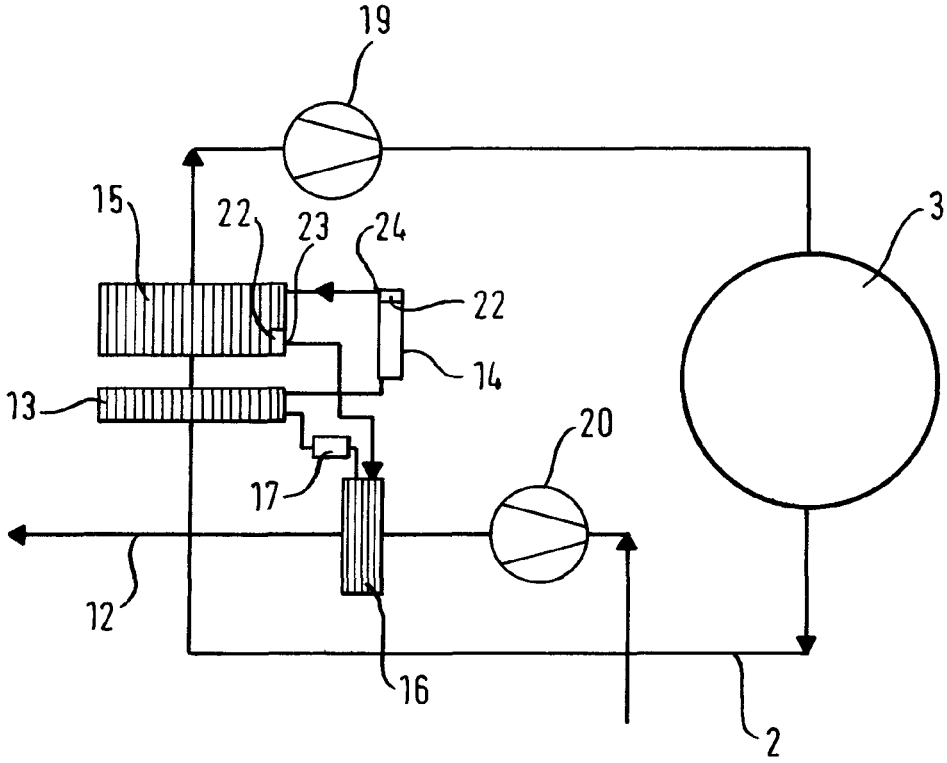
FIG. 2 is a schematic of the process-air circuit and heat pump for the first embodiment variant shown in FIG. 1.

FIG. 2 is a schematic of the process-air circuit and heat pump for the first embodiment variant shown in FIG. 1. While the process air is being ducted in the closed process-air circuit 2 and the coolant is being ducted in the closed circuit in heat pump 13, 14, 15, 17, the air used by means of second fan 20 for cooling in the additional heat exchanger 16 is taken from the ambient air and fed back to the ambient air after passing through the additional heat exchanger 16.

Figure 3:
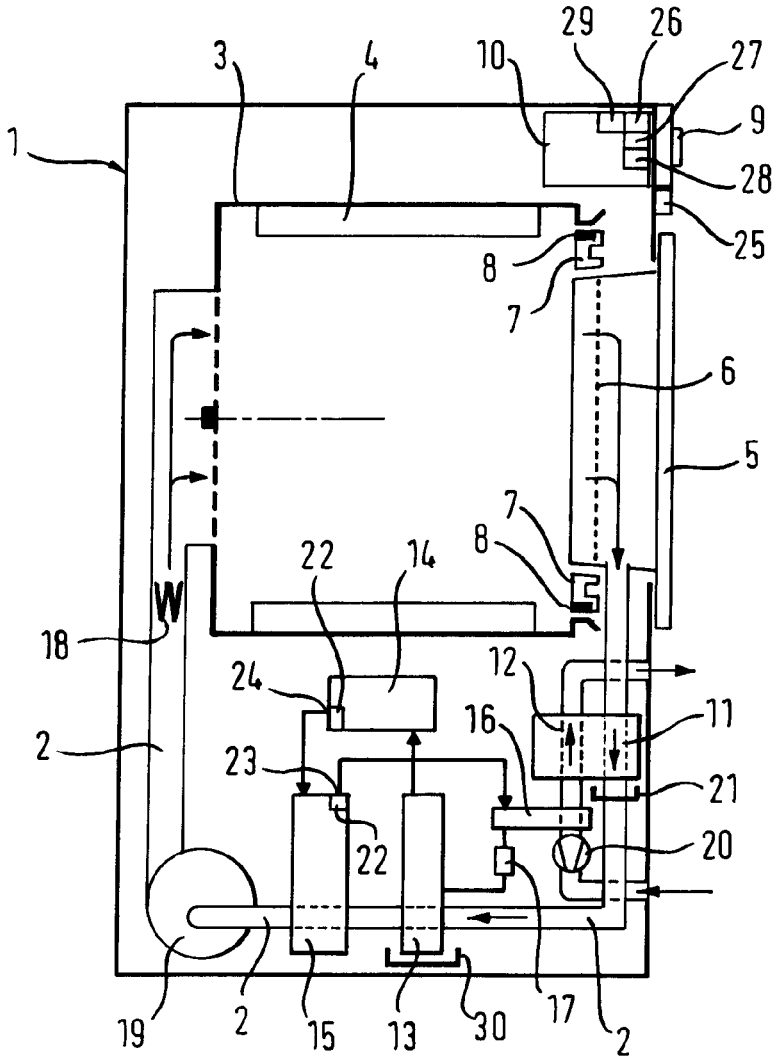
FIG. 3 shows a vertical section through a condensation dryer according to a second embodiment variant in which an additional heater and an additional air-air heat exchanger are used.

FIG. 3 shows a vertically sliced condensation dryer (abbreviated in the following to "dryer") according to a second embodiment variant in which there is an additional heat exchanger both in the heat pump and in the cooling-air channel of an air-air heat exchanger. An additional heater is also used in the embodiment variant shown in FIG. 3.

The dryer 1 shown in FIG. 3 has a drum, rotatable around a horizontal axis, as a drying chamber 3 within which are secured carriers 4 for moving the laundry while the drum is rotating. process air is ducted by means of a first fan 19 across a heater 18 through a drum 3, an air-air heat exchanger 11, 12, and a heat pump 13, 14, 15, 17 in an air channel 2 in the closed circuit (process-air circuit 2). The moist, warm process air is cooled after passing through the drum 3 and is heated again after the moisture contained in the process air has been condensed. Air heated by the heater 18 or, as the case may be, the condenser 15 is therein ducted from behind, which is to say from a side of the drum 3 opposite a door 5 through said drum's perforated base, makes contact there with the laundry to be dried, and flows through the loading opening of the drum 3 to a lint filter 6 inside a door 5 sealing the loading opening. The air current is then diverted downward in the door 5 and ducted by the air channel 2 to the air-air heat exchanger 11, 12. The moisture absorbed from the laundry items by the process air condenses there at least partially as the result of cooling and is captured in the condensate container 21 from where it can be disposed of. The somewhat cooled process air is then ducted to the evaporator 13 of the heat pump 13, 14, 15, 17 where it is further cooled, with the condensate accruing there being captured in the condensate container 30 from where it can be disposed of by emptying or pumping away. The coolant of the heat pump 13, 14, 15, 17 evaporated in the evaporator 13 is ducted to the condenser 15 via a compressor 14. The coolant condenses in the condenser 15 and in so doing emits heat into the process air. The coolant now present in liquid form is then ducted to an additional heat exchanger 16 located in the cooling-air channel 12 of the air-air heat exchanger 11, 12 between that and a second fan 20, and from there via a throttle valve 17 back to the evaporator 13, as a result of which the coolant circuit will have been closed. The cooling air is taken from the ambient air and fed back to the ambient air after passing through air-air heat exchanger 11, 12.

The drum 3 is mounted in the embodiment variant shown in FIG. 3 on the back base by means of a pivot bearing and at the front by means of an end shield 7, with the drum 3 being supported by a brim on a glide strip 8 on the end shield 7 and thus held at the front end. The condensation dryer is controlled via a controller 10 that can be regulated by the user via a control unit 9.

In addition to the controller 10 or integrated in the controller 10, the condensation dryer 1 includes first means 26 for comparing a temperature $T_K$ of the coolant with an upper limiting temperature $T_K^{lim1}$ stored in the controller for the coolant; a second means 27 for switching the compressor 14 off if $T_K$ is greater than or equal to $T_K^{lim1}$; and for switching the compressor 14 on, and a counting device 28 for ascertaining a number n of cases in which the compressor 14 is switched on or off; and a third means 29 for comparing the number n with a prespecified limiting number $n_{lim}$ stored in controller 10 and for evaluating the difference $\Delta n=(n-n_{lim})$ with respect to the presence of an impermissible operating state.

23 signifies the outlet of the condenser 15. 24 signifies the outlet of the compressor 14. In the embodiment variant shown in FIG. 3 a temperature sensor 22 is arranged at each of outlets 23 and 24. A visual display means 25 serves to display an impermissible operating state.

Figure 4:
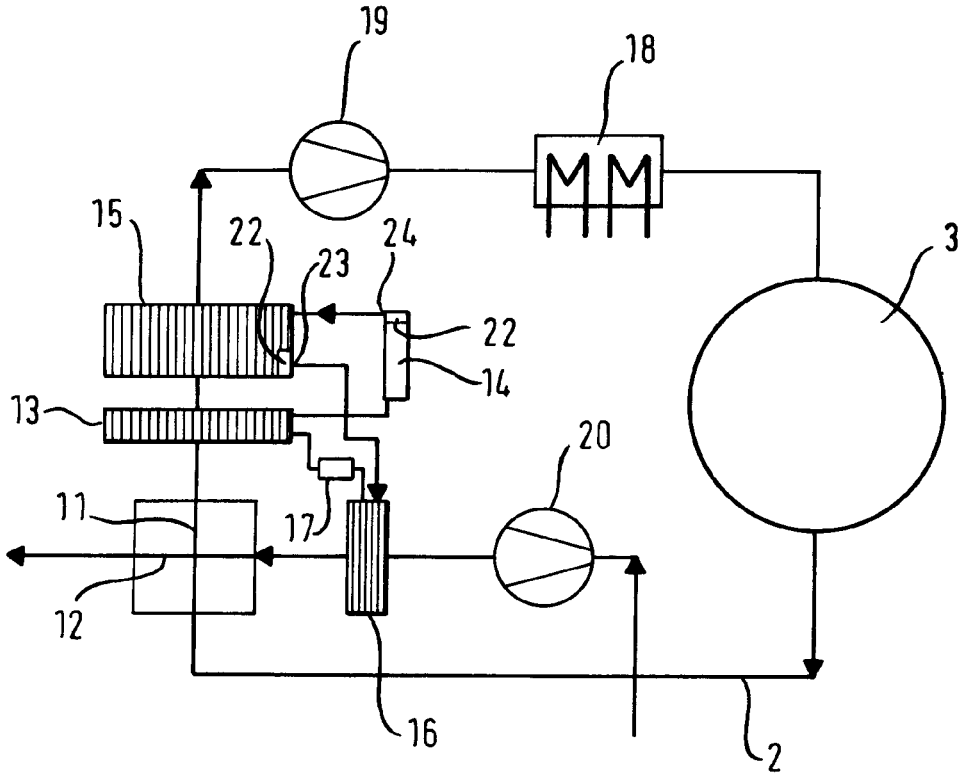
FIG. 4 is a schematic of the process-air circuit and heat pump for the second embodiment variant shown in FIG. 3.

FIG. 4 is a schematic of the process-air circuit and the heat-pump circuit for the second embodiment variant shown in FIG. 3. While the process air is being ducted in the closed process-air circuit 2 and the coolant is being ducted in the closed circuit of the heat pump 13, 14, 15, the air used for cooling in air-air-air heat exchanger 11, 12 is taken from the ambient air, ducted to the air-air-air heat exchanger 11, 12 via the second fan 20 after passing through the additional heat exchanger 16, and then fed back to the ambient air.

Figure 5:
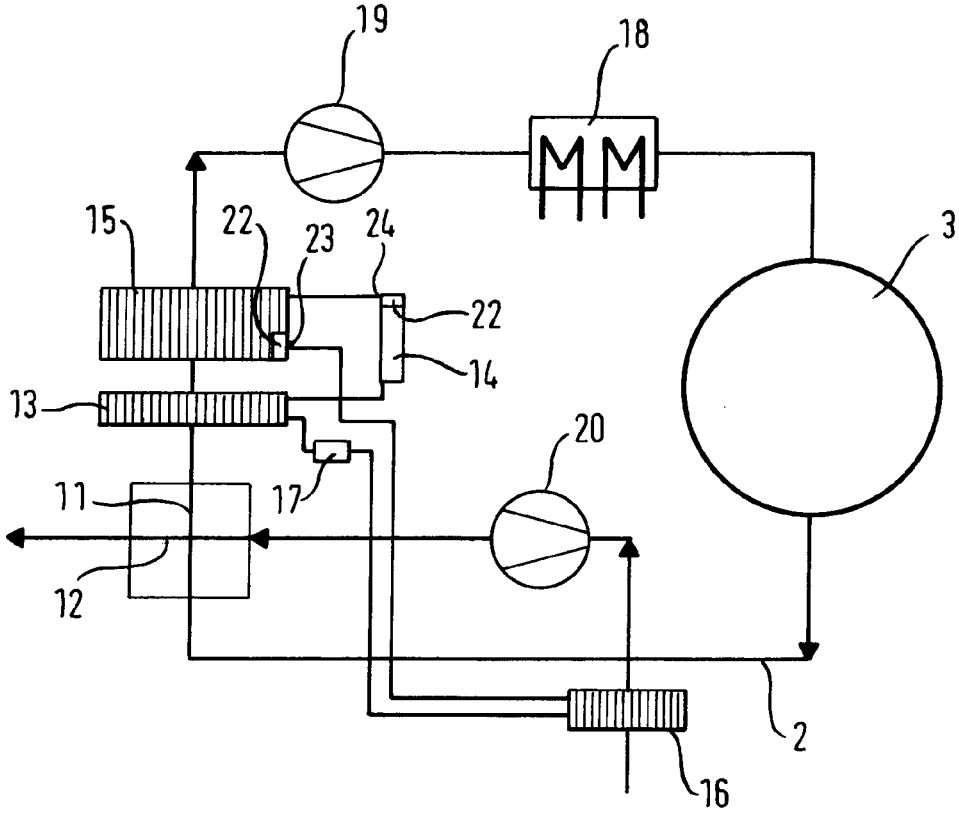
FIG. 5 is a schematic of the process-air circuit and heat pump for a third embodiment variant.

FIG. 5 is a schematic of the process-air circuit and heat-pump circuit for a third embodiment variant of the condensation dryer. The additional heat exchanger 16 is in that embodiment variant located in cooling-air channel 12 on the side facing away from the air-air heat exchanger 11, 12 of the second fan 20. The heat exchanger 16 is thus located in the cooling air's intake region.

The invention has the advantage that a condensation dryer's operation can be monitored simply and effectively. Impermissible operating states can be reliably displayed so that suitable countermeasures can be taken. The heat pump and particularly its condenser are able to operate within an optimum temperature range. That enables the condensation dryer to operate with a particularly favorable energy balance.

The heat pump will also be protected. It will in any event be easily possible to detect an impermissible operating state in a condensation dryer of such kind; remedial action can hence readily and promptly be applied or operation under critical conditions prevented.

The invention claimed is:

1. A condensation dryer, comprising:
- a drying chamber for items to be dried;
- a process-air circuit having a first fan;
- a heat pump in which a coolant circulates;
- an evaporator;
- a compressor;
- a condenser;
- a throttle;
- a temperature sensor to measure a temperature of the coolant; and
- a controller to store an upper limiting temperature of the coolant and a prespecified limiting number; the controller having:
  - a first comparator to compare the temperature of the coolant with the upper limiting temperature of the coolant;
  - a switch to switch the compressor off if the temperature of the coolant is greater than or equal to the upper limiting temperature of the coolant and to switch the compressor on after each compressor disconnection;
  - a counter to ascertain a number of occurrences at which the compressor is switched off, wherein the counter is incremented by 1 each time the switching-off of the compressor takes place; and
  - a second comparator to compare the number of occurrences with the prespecified limiting number stored in the controller and to evaluate a number difference between the number of occurrences and the prespecified limiting number with respect to the presence of an impermissible operating state of the condensation dryer.

2. The condensation dryer of claim 1, wherein the switch switches the compressor on only after expiration of a first delay period after each compressor disconnection.

3. The condensation dryer of claim 2, wherein the first delay period is greater than a period of time within which pressure equalizing occurs inside the heat pump after each compressor disconnection.

4. The condensation dryer of claim 2, wherein the first delay period is substantially three minutes long.

5. The condensation dryer of claim 2, wherein the switch is configured such that:
- on expiration of the first delay period after the compressor has been switched off, a determination is made as to whether the temperature of the coolant is greater than or equal to the upper limiting temperature;
- the compressor is only switched on again if the temperature of the coolant is smaller than the upper limiting temperature; and
- the counter is incremented by 1 and the switching on again of the compressor does not occur during a second delay period if the temperature of the coolant is greater than or equal to the upper limiting temperature.

6. The condensation dryer of claim 1, wherein the temperature sensor is located on an outlet of one of the condenser and the compressor.

7. The condensation dryer of claim 1, further comprising a heat exchanger in the heat pump.

8. The condensation dryer of claim 7, further comprising a process-air channel between the evaporator and the condenser, wherein the heat exchanger is in the process-air channel.

9. The condensation dryer of claim 7, further comprising a cooling-air channel, wherein the heat exchanger is in the cooling-air channel.

10. The condensation dryer of claim 1, further comprising a second fan for cooling the heat pump.

11. The condensation dryer of claim 10, further comprising a cooling-air channel, wherein the second fan is in at least one of the cooling-air channel and a vicinity of the compressor.

12. The condensation dryer of claim 11, further comprising at least one of an acoustic and a visual display to display the impermissible operating state of the condensation dryer.

13. A method for operating a condensation dryer having a drying chamber for items to be dried; a process-air circuit having a first fan; a heat pump in which a coolant circulates; an evaporator; a compressor; a condenser; a throttle; and a controller, the method comprising:

setting the counter to zero and switching on the compressor by means of a switch;

cyclically repeated measuring of a temperature of the coolant by means of the temperature sensor and comparing the temperature of the coolant by means of a first comparator with an upper limiting temperature stored in the controller;

switching off the compressor by means of the switch if the temperature of the coolant is greater than or equal to the upper limiting temperature;

incrementing the number of occurrences in the counter by 1 each time the compressor is switched off;

switching on again of the compressor again by means of the switch after each compressor disconnection;

comparing, by means of a second comparator, the number of occurrences with a prespecified limiting number stored in the controller; and evaluating a number difference between the number of occurrences and the prespecified limiting number with respect to the presence of an impermissible operating state of the condensation dryer.

14. The method of claim 13, wherein the switch switches the compressor on again only after a first delay period has expired after each compressor disconnection.

15. The method of claim 14, wherein, on expiration of the first delay period after the compressor has been switched off, the switch ascertains whether the temperature of the coolant is greater than or equal to the upper limiting temperature; wherein the switch only switches the compressor on again if the temperature of the coolant is smaller than the upper limiting temperature; and wherein the counter is incremented by 1 and the compressor is not switched on again for a second delay period if the temperature of the coolant is greater than or equal to the upper limiting temperature.

16. The method of claim 13, wherein a first impermissible operating state is indicated if the number difference is greater than or equal to a first prespecified value stored in the controller.

17. The method of claim 16, wherein the indication of the first impermissible operating state includes a request to clean air paths in the condensation dryer.

18. The method of claim 13, wherein a second impermissible operating state is indicated if the number of occurrences is greater than or equal to a prespecified value stored in the controller.

19. The method of claim 18, wherein, in addition to indicating the second impermissible operating state, a drying process in progress is interrupted.

* * * * *